US007735287B2

(12) United States Patent
Gaudreau

(10) Patent No.: US 7,735,287 B2
(45) Date of Patent: Jun. 15, 2010

(54) ROOFING PANELS AND ROOFING SYSTEM EMPLOYING THE SAME

(75) Inventor: Michel Gaudreau, Quebec (CA)

(73) Assignee: Novik, Inc., St. Augustine-De-Desmaures, Quebec (CA)

( * ) Notice: Subject to any disclaimer, the term of this patent is extended or adjusted under 35 U.S.C. 154(b) by 0 days.

(21) Appl. No.: 11/656,728

(22) Filed: Jan. 23, 2007

(65) Prior Publication Data

US 2008/0083186 A1 Apr. 10, 2008

Related U.S. Application Data

(60) Provisional application No. 60/849,218, filed on Oct. 4, 2006.

(51) Int. Cl.
*E04D 1/00* (2006.01)

(52) U.S. Cl. ..... 52/526; 52/525; 52/536

(58) Field of Classification Search ..... 52/518, 52/519, 520, 521, 522, 523, 524, 525, 526, 52/527, 528, 529, 530, 531, 532, 533, 534, 52/535, 536, 537, 538, 539, 540, 541, 542, 52/543, 544, 545, 546, 547, 548, 549, 550, 52/551, 552, 553, 554, 555, 556, 557, 558, 52/559, 560

See application file for complete search history.

(56) References Cited

U.S. PATENT DOCUMENTS 448,733 A * 3/1891 Sagendorph ..... 52/526
1,447,561 A 3/1923 Overbury
1,467,510 A 9/1923 Smith, Jr.
1,701,704 A * 2/1929 Vernon ..... 52/525
1,767,374 A 6/1930 Kirschbraun
1,795,913 A 3/1931 Weaver
2,096,968 A 10/1937 Johnston
2,156,277 A * 5/1939 Corbin, Jr. ..... 52/509
3,430,395 A * 3/1969 Lashkow ..... 52/528
3,504,467 A 4/1970 Hatch et al.
3,754,366 A * 8/1973 Jansson et al. ..... 52/535
3,783,570 A * 1/1974 Storch ..... 52/520
3,973,369 A 8/1976 Smith
3,977,145 A 8/1976 Dobby et al.
4,015,391 A * 4/1977 Epstein et al. ..... 52/520
4,033,499 A 7/1977 Butler
4,034,528 A * 7/1977 Sanders et al. ..... 52/309.4
4,070,432 A 1/1978 Tamaddon
4,070,843 A 1/1978 Leggiere et al.

(Continued)

OTHER PUBLICATIONS

Vand Hey Raleigh. http://www.vhr-roof-tile.com/index.htm, Mar. 26, 2007.

(Continued)

*Primary Examiner*—Richard E Chilcot, Jr.
*Assistant Examiner*—Matthew J Gitlin
(74) *Attorney, Agent, or Firm*—Butzel Long

(57) ABSTRACT

A roofing system comprising a plurality of roofing panels each having a bottom surface and a top surface, opposite upper and lower edges and opposite lateral edges. The top surface of each roofing panel has the appearance of a plurality of individual shingles. The roofing panels are adapted for sliding engagement with each other along their opposite upper and lower edges and opposite lateral edges when positioned vertically and horizontally adjacent.

14 Claims, 12 Drawing Sheets

U.S. PATENT DOCUMENTS

| | | | | | |
|---|---|---|---|---|---|
| 4,096,679 | A | | 6/1978 | Naz | |
| 4,104,841 | A | | 8/1978 | Naz | |
| 4,186,538 | A | * | 2/1980 | Marcum, Jr. | 52/521 |
| 4,189,878 | A | | 2/1980 | Fitzgerald et al. | |
| 4,219,981 | A | | 9/1980 | Stewart et al. | |
| 4,251,967 | A | | 2/1981 | Hoofe, III | |
| 4,288,959 | A | | 9/1981 | Murdock | |
| 4,319,439 | A | | 3/1982 | Gussow | |
| 4,343,126 | A | | 8/1982 | Hoofe, III | |
| 4,382,993 | A | | 5/1983 | McIntyre et al. | |
| 4,434,200 | A | | 2/1984 | Fash et al. | |
| 4,437,602 | A | | 3/1984 | Kaczmarek | |
| 4,445,301 | A | | 5/1984 | Tanski | |
| 4,472,913 | A | | 9/1984 | Hickman | |
| 4,476,661 | A | | 10/1984 | Hoofe, III | |
| 4,498,267 | A | | 2/1985 | Beck | |
| 4,499,702 | A | | 2/1985 | Turner | |
| 4,522,002 | A | * | 6/1985 | Davis et al. | 52/309.1 |
| 4,544,595 | A | | 10/1985 | Tomason | |
| 4,580,383 | A | * | 4/1986 | Pittman et al. | 52/520 |
| 4,588,634 | A | | 5/1986 | Pagen et al. | |
| 4,592,185 | A | * | 6/1986 | Lynch et al. | 52/543 |
| 4,593,512 | A | * | 6/1986 | Funaki | 52/519 |
| 4,598,522 | A | | 7/1986 | Hoofe, III | |
| 4,617,770 | A | | 10/1986 | Hickman | |
| 4,617,774 | A | | 10/1986 | Pittman et al. | |
| 4,618,440 | A | | 10/1986 | Steinberg et al. | |
| 4,627,207 | A | | 12/1986 | Young et al. | |
| 4,641,472 | A | | 2/1987 | Young et al. | |
| 4,663,373 | A | | 5/1987 | Ravichandran et al. | |
| 4,671,753 | A | | 6/1987 | Payne | |
| 4,671,991 | A | | 6/1987 | Payne | |
| 4,680,911 | A | * | 7/1987 | Davis et al. | 52/521 |
| 4,712,351 | A | | 12/1987 | Kasprzak | |
| 4,717,614 | A | | 1/1988 | Bondoc et al. | |
| 4,729,202 | A | | 3/1988 | Ferland | |
| 4,749,533 | A | | 6/1988 | Payne | |
| 4,777,776 | A | | 10/1988 | Morrell | |
| 4,782,638 | A | | 11/1988 | Hovind | |
| 4,795,661 | A | | 1/1989 | Bondoc et al. | |
| 4,798,033 | A | | 1/1989 | Weide | |
| 4,803,144 | A | | 2/1989 | Hosoi | |
| 4,825,616 | A | | 5/1989 | Bondoc et al. | |
| 4,879,333 | A | | 11/1989 | Frazee | |
| 4,890,432 | A | * | 1/1990 | Shepherd | 52/314 |
| 4,936,071 | A | * | 6/1990 | Karrfalt | 52/420 |
| 4,940,844 | A | | 7/1990 | Blunt | |
| 4,946,992 | A | | 8/1990 | Falk et al. | |
| 5,039,740 | A | | 8/1991 | Anderson et al. | |
| 5,047,556 | A | | 9/1991 | Kohler et al. | |
| 5,060,444 | A | * | 10/1991 | Paquette | 52/535 |
| 5,072,562 | A | * | 12/1991 | Crick et al. | 52/533 |
| 5,084,506 | A | | 1/1992 | Faler et al. | |
| 5,088,910 | A | | 2/1992 | Goforth et al. | |
| 5,096,046 | A | | 3/1992 | Goforth et al. | |
| 5,100,274 | A | | 3/1992 | Hasan et al. | |
| 5,106,609 | A | | 4/1992 | Bolich, Jr. et al. | |
| 5,124,098 | A | | 6/1992 | Vischer | |
| 5,126,392 | A | | 6/1992 | Nakashima | |
| 5,135,971 | A | | 8/1992 | Steirt et al. | |
| 5,141,983 | A | | 8/1992 | Hasegawa et al. | |
| 5,186,980 | A | | 2/1993 | Koschitzky | |
| 5,188,895 | A | | 2/1993 | Nishino | |
| 5,224,318 | A | | 7/1993 | Kemerer | |
| 5,229,207 | A | | 7/1993 | Paquette et al. | |
| D339,875 | S | | 9/1993 | Schutz et al. | |
| 5,249,402 | A | * | 10/1993 | Crick et al. | 52/533 |
| 5,287,669 | A | | 2/1994 | Hannah et al. | |
| 5,288,787 | A | | 2/1994 | Sackmann et al. | |
| 5,295,339 | A | | 3/1994 | Manner | |
| 5,305,569 | A | | 4/1994 | Malmquist et al. | |
| 5,305,570 | A | | 4/1994 | Rodriguez et al. | |
| 5,344,007 | A | | 9/1994 | Nakamura et al. | |
| 5,347,784 | A | * | 9/1994 | Crick et al. | 52/520 |
| 5,349,802 | A | | 9/1994 | Kareniemi | |
| 5,363,623 | A | * | 11/1994 | King | 52/520 |
| 5,375,491 | A | | 12/1994 | Hannah et al. | |
| 5,400,558 | A | | 3/1995 | Hannah et al. | |
| RE34,951 | E | | 5/1995 | Slosberg et al. | |
| 5,416,151 | A | | 5/1995 | Tanaka | |
| 5,421,134 | A | | 6/1995 | Hannah et al. | |
| 5,437,735 | A | | 8/1995 | Younan et al. | |
| 5,444,954 | A | * | 8/1995 | Anderson | 52/288.1 |
| 5,501,056 | A | | 3/1996 | Hannah et al. | |
| 5,524,412 | A | | 6/1996 | Corl | |
| 5,537,792 | A | * | 7/1996 | Moliere | 52/531 |
| 5,575,861 | A | | 11/1996 | Younan et al. | |
| 5,577,361 | A | | 11/1996 | Grabek, Jr. et al. | |
| 5,592,799 | A | | 1/1997 | Reinke | |
| 5,613,337 | A | * | 3/1997 | Plath et al. | 52/533 |
| 5,622,020 | A | * | 4/1997 | Wood | 52/546 |
| 5,635,125 | A | | 6/1997 | Ternes et al. | |
| 5,636,481 | A | | 6/1997 | De Zen | |
| 5,675,955 | A | * | 10/1997 | Champagne | 52/521 |
| 5,687,090 | A | | 11/1997 | Chen et al. | |
| 5,731,033 | A | | 3/1998 | Hanisco | |
| 5,763,083 | A | | 6/1998 | Berrigan | |
| 5,784,848 | A | * | 7/1998 | Toscano | 52/519 |
| 5,813,184 | A | | 9/1998 | McKenna | |
| 5,821,294 | A | | 10/1998 | Perlinski | |
| 5,853,858 | A | | 12/1998 | Bondoc | |
| 5,878,543 | A | | 3/1999 | Mowery | |
| 5,922,379 | A | | 7/1999 | Wang | |
| 5,956,914 | A | | 9/1999 | Williamson | |
| 5,960,596 | A | | 10/1999 | Lyons, Sr. | |
| 5,992,116 | A | | 11/1999 | Ternes et al. | |
| 6,038,827 | A | | 3/2000 | Sieling | |
| 6,044,609 | A | | 4/2000 | Kim | |
| 6,050,041 | A | * | 4/2000 | Mowery et al. | 52/520 |
| 6,058,670 | A | | 5/2000 | Sieling | |
| 6,092,302 | A | | 7/2000 | Berrigan | |
| 6,105,329 | A | | 8/2000 | Bondoc et al. | |
| 6,114,007 | A | | 9/2000 | Brandon et al. | |
| 6,122,878 | A | | 9/2000 | Pliley | |
| 6,153,293 | A | | 11/2000 | Dahl et al. | |
| 6,180,257 | B1 | | 1/2001 | Brandt et al. | |
| 6,224,701 | B1 | * | 5/2001 | Bryant et al. | 156/73.1 |
| 6,248,813 | B1 | | 6/2001 | Zehner | |
| 6,258,876 | B1 | | 7/2001 | Medoff et al. | |
| 6,282,858 | B1 | * | 9/2001 | Swick | 52/533 |
| 6,301,856 | B1 | | 10/2001 | Nasi | |
| 6,336,303 | B1 | | 1/2002 | Vandeman et al. | |
| 6,360,508 | B1 | * | 3/2002 | Pelfrey et al. | 52/520 |
| 6,361,851 | B1 | | 3/2002 | Sieling et al. | |
| 6,421,975 | B2 | | 7/2002 | Bryant et al. | |
| 6,436,471 | B1 | | 8/2002 | Peterson | |
| 6,487,828 | B1 | | 12/2002 | Phillips | |
| 6,550,362 | B1 | | 4/2003 | Galient et al. | |
| 6,579,605 | B2 | | 6/2003 | Zehner | |
| 6,715,240 | B2 | * | 4/2004 | Beck et al. | 52/105 |
| 6,715,250 | B2 | | 4/2004 | Bryant et al. | |
| 6,786,804 | B2 | | 9/2004 | Watanabe | |
| 6,939,036 | B2 | * | 9/2005 | Beck et al. | 374/55 |
| 6,955,019 | B2 | * | 10/2005 | Donlin et al. | 52/520 |
| 6,976,342 | B1 | * | 12/2005 | Kowalevich | 52/546 |
| 6,983,571 | B2 | | 1/2006 | Felton | |
| 6,988,345 | B1 | * | 1/2006 | Pelfrey et al. | 52/519 |
| 7,089,709 | B2 | | 8/2006 | Waggoner | |
| 7,207,145 | B2 | * | 4/2007 | Stucky et al. | 52/555 |
| 7,240,461 | B1 | * | 7/2007 | Vandeman et al. | 52/539 |
| 2001/0039778 | A1 | * | 11/2001 | King | 52/522 |
| 2002/0098110 | A1 | * | 7/2002 | Graham et al. | 422/28 |
| 2003/0182888 | A1 | * | 10/2003 | Desbois et al. | 52/551 |
| 2005/0102946 | A1 | * | 5/2005 | Stucky et al. | 52/518 |

| | | | | |
|---|---|---|---|---|
| 2006/0032527 | A1 * | 2/2006 | Stevens et al. | 136/251 |
| 2007/0107356 | A1 * | 5/2007 | Steffes et al. | 52/518 |
| 2007/0144096 | A1 | 6/2007 | O'Neal | |

OTHER PUBLICATIONS

Slate Roof Tile. Our Product. [online]. Vande Hey Raleigh [retrieved on Jan. 3, 2006]. Retrieved from the internet. <URL: www.vhr-roof-tile.com/products_modernslate.htm>.

Lightweight Slate Installation and Specification Manual. Installation and Specification Manuals. [online]. Vande Hey Raleigh, 2004 [retrieved on Jan. 3, 2006] Retrieved from Internet:<URL:www.vhr-roof-tile.com/PDF/LightweightSlateManual.pdf>.

Riviera Concrete Roof Tile. Our Products. [online]. Vande Hey Raleigh [retrieved on Jan. 3, 2006].Retrived from the internet:<URL:www.vhr-roof-tile.com/products_rivera.html>.

Max Slate General Information. Products. Installation Manuals. [online]. Max Roofing Products. [retrieved on Jan. 3, 2006]. Retrieved from Internet: <URL:www.maxroofingproducts.com/Manuals/Max%20Slate%20General%2CInfo.doc>.

Majestic Slate Product Technical Data. Products. Majestic Slate Traditional. Product Technical Data-Class-C, [online]Carlisle Syntec Incorporated Ecostar,2004 [retrieved on Jan. 3, 2006] Retrieved from Internet:<URL: www.ecostar.carlisle.com/PDFs/majestic-data.pdf>.

Dura Slate Roofing Systems.Products[online]. Royal Building Products retrieved from the Internet:<URL: www.royalbuildingproducts.com/html/products/roofing/profilespecs.html>.

Max Slate Product Information Sheet. Products. Literature. [online]. Max Roofing Products [retrieved on Jan. 3, 2006]. Retrieved from Internet: <URL:www.maxroofingproducts.com/Literature/MAX-Slate.pdf>.

Max Slate Lab Testing Summary. Products. Literature. [online]. Max Roofing Products[retrieved on Jan. 3, 2006]. Retrieved from Internet: <URL:www.maxroofingproducts.com/Literature/MAX-Slate.pdf>.

Majestic Slate. Eoco-Star Installation Guides. [online] Carlisle Syntec Incorporated EcoStar[retrieved on Jan. 3, 2006] Retrieved from Internet: <URL:www.ecostar.carlisle.com/PDFs/majestic-install-guide.pdf>.

* cited by examiner

ROOFING PANELS AND ROOFING SYSTEM EMPLOYING THE SAME

CROSS-REFERENCE TO RELATED APPLICATIONS

This application is related to, and claims the benefit of priority from, Provisional Application Ser. No. 60/849,218, filed Oct. 4, 2006.

STATEMENT REGARDING FEDERALLY SPONSORED RESEARCH OR DEVELOPMENT

Not applicable.

INCORPORATION BY REFERENCE OF MATERIAL SUBMITTED ON A COMPACT DISC

Not applicable.

FIELD OF THE INVENTION

The present invention pertains to the field of roofing, and more particularly to a roofing system comprising a plurality of roofing panels, each roofing panel having the appearance of a plurality of individual shingles and adapted to be slidingly engageable with like roofing panels disposed horizontally and vertically adjacent thereto.

BACKGROUND

For years the task of roofing a dwelling or other structure has conventionally been undertaken using a plurality of individual shingles, whether of asphalt, slate, tile, etc., These individual shingles must be painstakingly laid one at a time in successive horizontal rows starting at a roof's lower edge and proceeding upwardly therefrom to the peak, with each individual shingle being fastened to the roofing substrate. This is a labor intensive and time consuming process. Moreover, the shingles of each successive row must be laid so as to slightly overlap those of the preceding row, an arrangement requiring considerable care in order to ensure that the rows of shingles are disposed in proper relative position. Further complicating this task is the fact that successive rows of shingles are often staggered in relation to preceding rows in order to provide a more aesthetically pleasing appearance to the finished roof. This requires an even greater degree of care to ensure that the individual shingles are properly aligned to convey the desired appearance.

Apart from the issue of time, roofing can also be expensive, particularly where more exotic roofing materials such as slate, tile, or wood are desired. Accordingly, it is most common to employ as roofing comparatively inexpensive asphalt shingles. However, others have more recently developed polymeric roofing which resembles such exotic roofing materials. But despite this advance, little has been done heretofore to facilitate the rapid completion of the roofing task. At best, others have developed roofing panels having the appearance of just two or three individual shingles arranged side-by-side horizontally in a single row. While such roofing materials may speed up the process of laying each successive row of shingles, the improvement is only marginal over the conventional roofing installation methodology.

SUMMARY OF THE DISCLOSURE

The present invention addresses the foregoing problems of the prior art in the provision of a roofing system a plurality of roofing panels each having a bottom surface and a top surface, opposite upper and lower edges and opposite lateral edges. The top surface has the appearance of a plurality of individual shingles. The roofing panels are adapted for sliding engagement with each other along their opposite upper and lower edges and opposite lateral edges when positioned vertically and horizontally adjacent.

In one embodiment of the present invention, the top surface of each roofing panel has the appearance of a plurality of individual shingles arranged in a plurality of vertically adjacent, horizontally extending rows. In one variation of this embodiment, the top surface of each roofing panel has the appearance of a plurality of individual shingles arranged in a plurality of vertically adjacent, horizontally extending rows with each successive row staggered relative to the preceding row. The lateral edges of each roofing panel are stepped to correspond to the staggered rows.

According to one feature of the present invention, each roofing panel comprises a plurality of hooks disposed proximate one of the upper or lower edges and one of the lateral edges, and a plurality of tabs disposed proximate the other of the upper or lower edges and the other of the lateral edges. The tabs of each roofing panel are slidingly receivable within the hooks of vertically and horizontally adjacent roofing panels to thereby permit sliding engagement between roofing panels disposed horizontally and vertically adjacent each other.

In another feature of this invention, at least the upper edge of each roofing panel comprises a plurality of laterally extending slots for receiving fastening elements therethrough. The slots are defined along vertically recessed portions of the upper edge intermediate the plurality of tabs or hooks provided on the upper edge.

According to still another feature of the present invention, the bottom surface of each roofing panel includes a plurality of ribs projecting downwardly therefrom.

Per yet another feature of the instant invention, the roofing system comprises a plurality of edging strips each having the appearance of the bottom portions of a plurality of individual shingles arranged in a horizontal row. Each edging strip is slidingly engageable with the bottom edge of at least one roofing panel disposed vertically adjacent thereto.

In one embodiment, each edging strip comprises a plurality of hooks or tabs disposed proximate an upper edge of the edging strip, these hooks or tabs adapted to engage with the hooks or tabs provided on the bottom edge of a vertically adjacent roofing panel to permit sliding engagement therebetween. In another aspect of this embodiment, the upper edge of each edging strip further comprises a plurality of laterally extending slots for receiving fastening elements therethrough, the slots being defined along vertically recessed portions of the upper edge intermediate the plurality of tabs or hooks provided on said upper edge.

According to yet another feature of the present invention, each roofing panel further comprises indicia facilitating the selective horizontal spacing of each roofing panel with a horizontally adjacent roofing panel. In one embodiment thereof, these indicia comprise a plurality of temperature lines each indicating a predetermined horizontal spacing between horizontally adjacent roofing panels at a predetermined ambient temperature.

Per still another inventive feature, each edging strip of the presently disclosed roofing system further comprises indicia facilitating the selective horizontal spacing of each edging strip with a horizontally adjacent edging strip. In one embodiment thereof, these indicia comprise a plurality of temperature lines each indicating a predetermined horizontal spacing between horizontally adjacent edging strips at a predetermined ambient temperature.

According to yet another inventive feature of the present invention, each roofing panel includes at least one flexible stop projecting from the bottom surface thereof, the at least one stop positioned for abutting contact with a lateral edge of another roofing panel positioned vertically adjacent thereto. In one embodiment thereof, each roofing panel is provided with a plurality of such flexible stops positioned proximate each of the plurality of hooks disposed proximate the upper or lower edges. Each such stop projects from the bottom surface of each roofing panel so as to be positioned for abutting contact with a lateral edge of another roofing panel positioned vertically adjacent thereto.

BRIEF DESCRIPTION OF THE DRAWINGS

The present invention may be better understood with reference to the written description and drawings, of which.

DETAILED DESCRIPTION

Figure 1A:
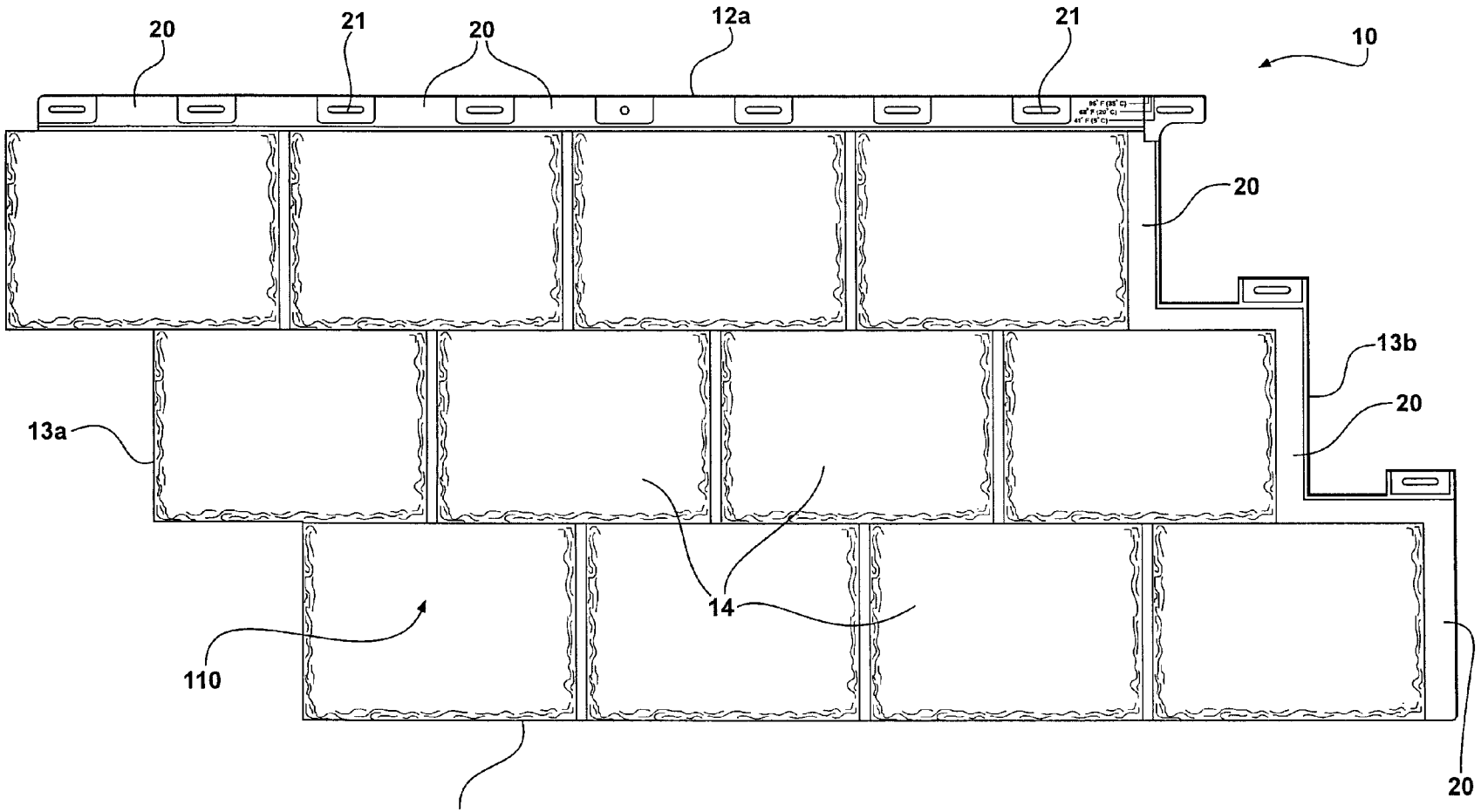
FIG. 1A comprises a top plan view of a single roofing panel according to the exemplary embodiment of the present invention.

Referring now to the drawings, wherein like numerals refer to like or corresponding parts among the several views, the present invention will be seen to most generally comprise a roofing system including a plurality of roofing panels adapted for sliding engagement with like roofing panels positioned vertically and horizontally adjacent thereto.

Figure 1B:
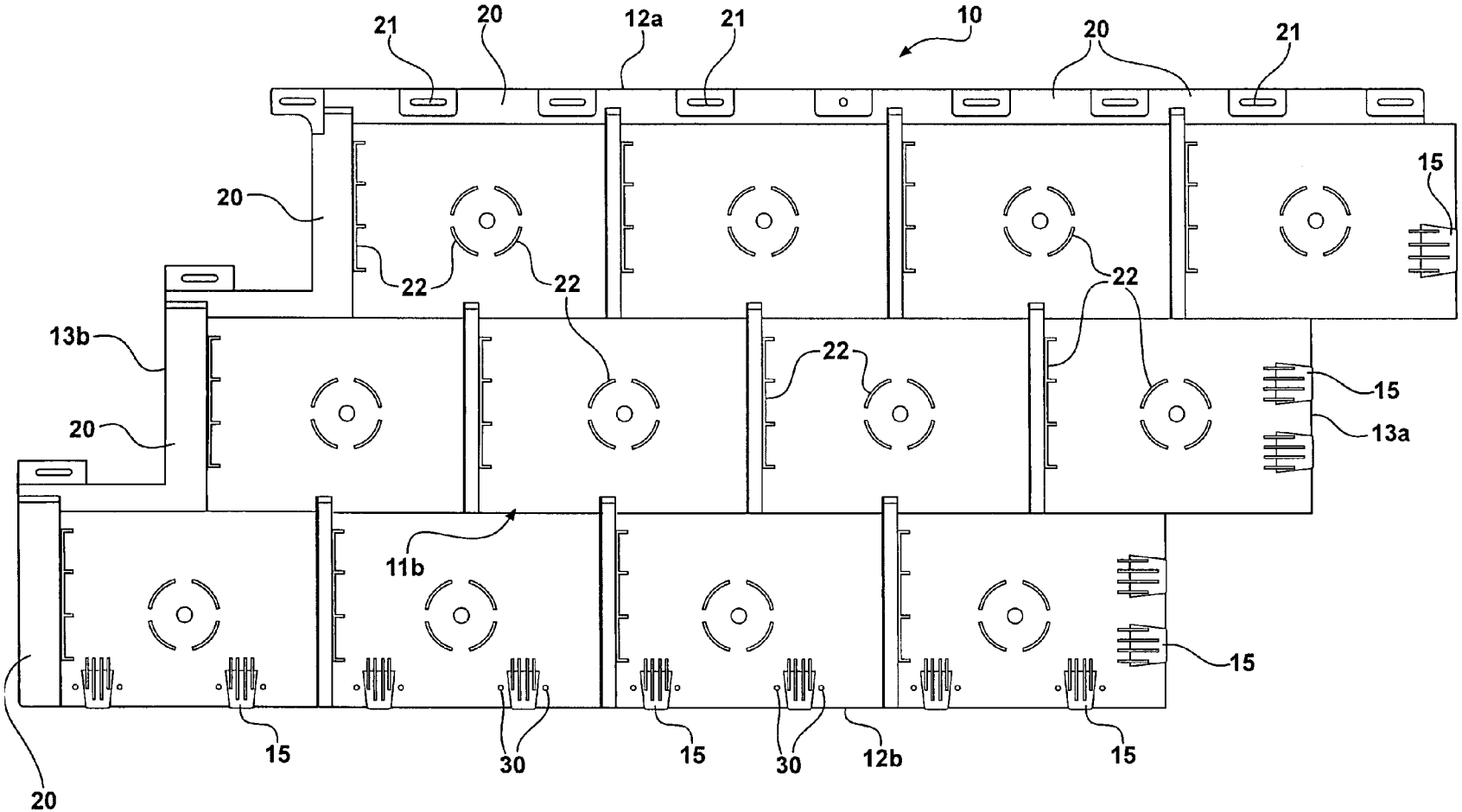
FIG. 1B comprises a bottom plan view of the roofing panel of FIG. 1A.
Figure 2A:
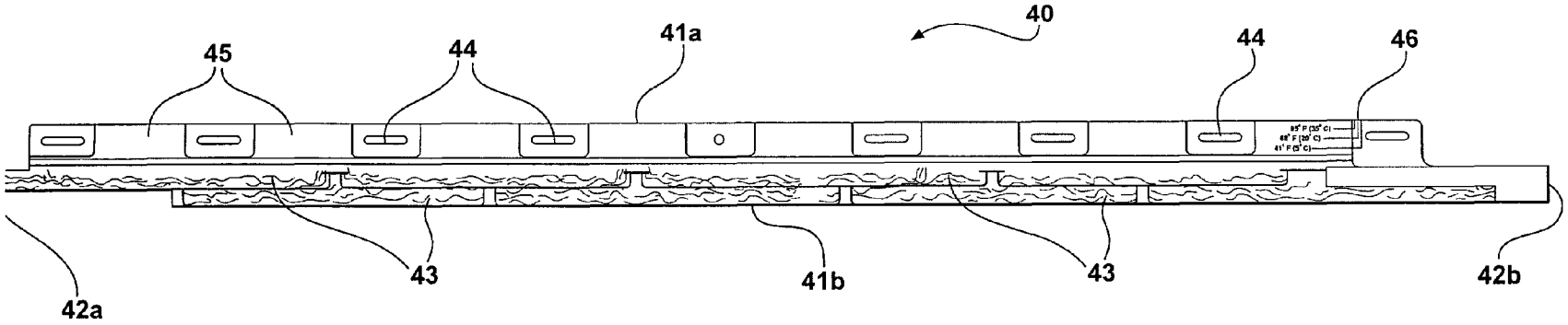
FIG. 2A is a top plan view of a single edging strip according to the exemplary embodiment of the present invention.
Figure 2B:
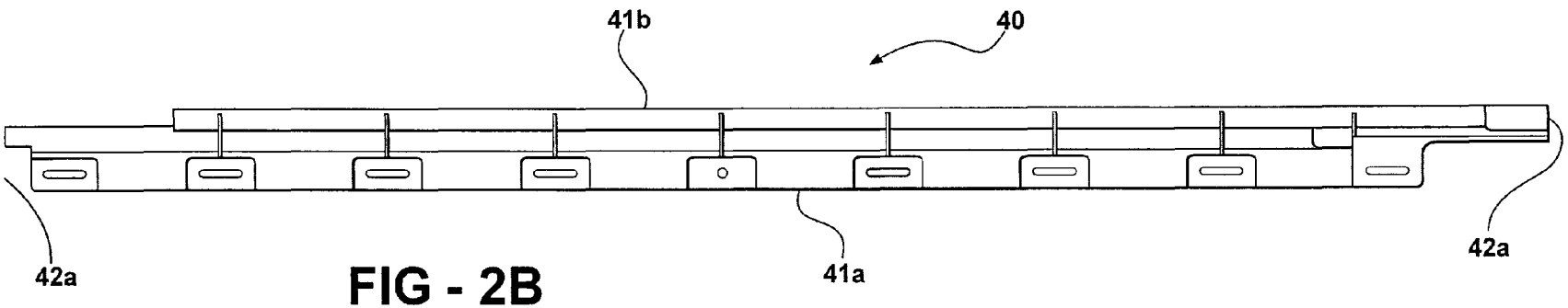
FIG. 2B comprises a bottom plan view of the edging strip of FIG. 2A.

Turning to FIGS. 1A and 1B, each such roofing panel 10 is characterized by an upper surface 11*a* (FIG. 1A) and a bottom surface 11*b* (FIG. 1B), opposite upper 12*a* and lower 12*b* edges and opposite lateral edges 13*a*, 13*b*.

With continuing reference to FIG. 1A, the upper surface 11*a* of each individual roofing panel 10 is formed to represent a plurality of vertically adjacent, horizontally extending rows of shingles 14. Still more particularly, the upper surface 11*a* of the illustrated embodiment is formed to create the appearance of a plurality of individual shingles 14 arranged in a plurality of vertically adjacent, horizontally extending rows. Further to this particular embodiment, each successive row is staggered relative to the preceding row, and the lateral edges 13*a*, 13*b* of the roofing panel 10 are correspondingly stepped to accommodate the staggered rows.

The roofing panels 10 of the present invention may be formed of any material known to be suited to use as a roofing material, with a polymeric material being preferred but not required. And while each roofing panel 10 as shown in the exemplary embodiment is monolithic, it will be understood that such construction is only preferred and that each roofing panel may, in the alternative, comprise an unitary element fashioned from two or more separate constituent components.

Referring particularly to FIG. 1B, sliding engagement between vertically and horizontally adjacent roofing panels is accomplished, in the illustrated embodiment, by the provision of a plurality of hooks 15 disposed proximate one or more of the upper 12*a* or lower 12*b* edges and one or more of the lateral edges 13*a*, 13*b*, and the provision of a plurality of tabs regions 20 disposed proximate one or more of the upper 12*a* or lower 12*b* edges and one or more of the lateral edges 13*a*, 13*b*.

Figure 9:
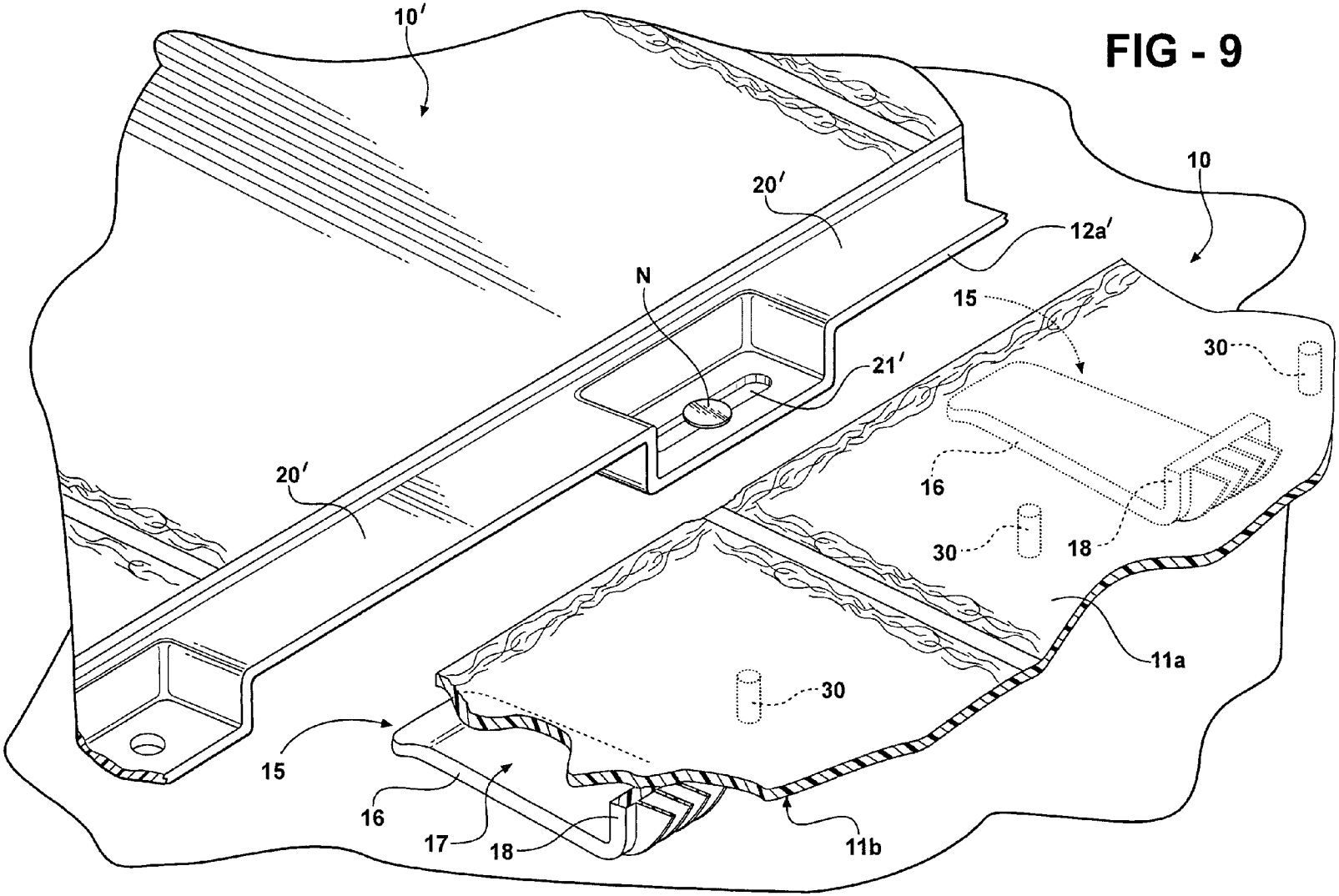
FIGS. 9, 9A, and 9B are detailed quartering perspectives of vertically adjacent roofing panels, depicting in detail the manner of engagement and subsequent relative movement between them.
Figure 9A:
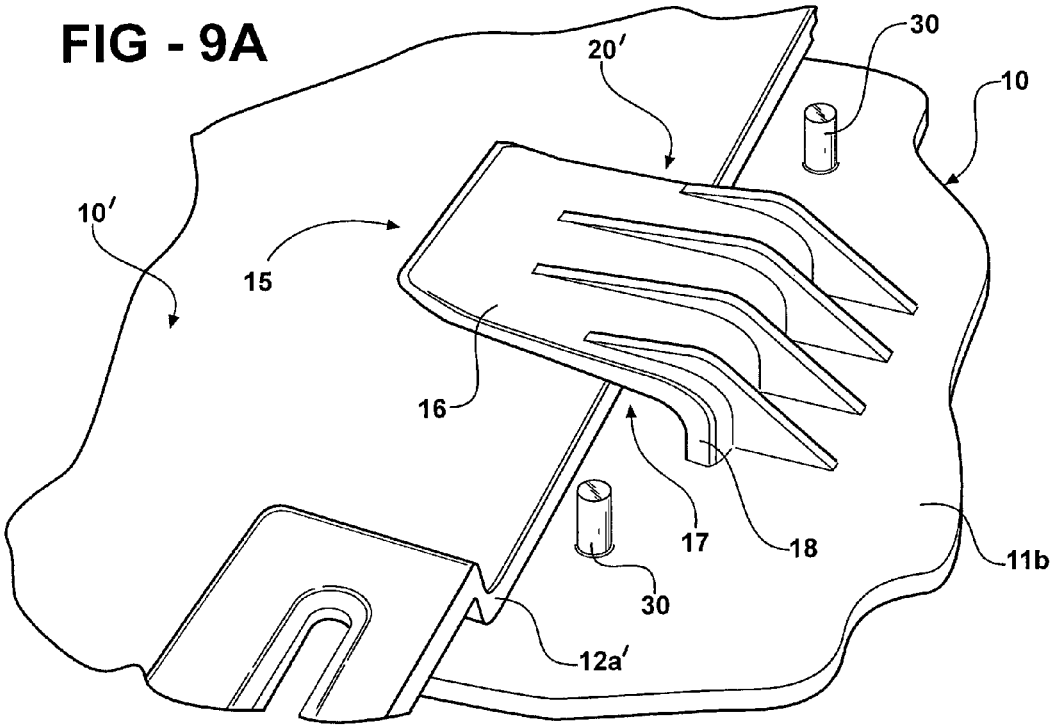
Figure 9B:
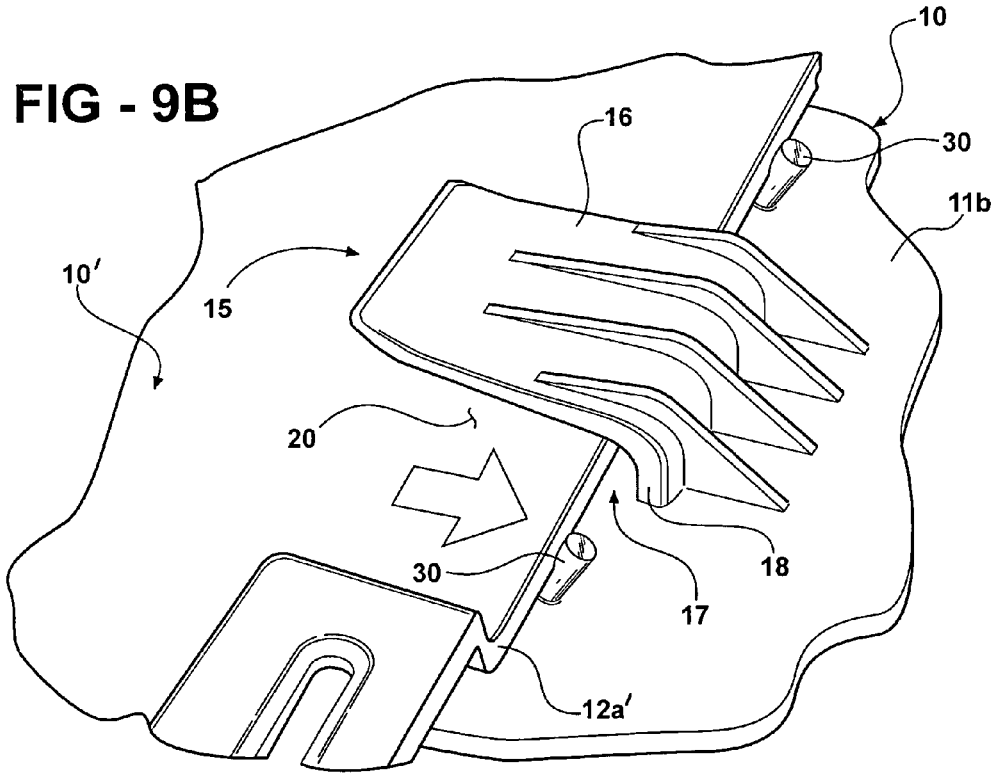

Referring also to FIGS. 9, 9A, and 9B, each hook 15 of this embodiment more specifically comprises a generally J-shaped jaw 16 extending from the bottom surface 11*b* of the panel 10 so as to define an intermediate opening 17—i.e., between the jaw 16 and the bottom surface 11*b*—dimensioned to slidingly receive therein a tab portion 20' of an adjacent panel 10'.

Each of the tabs portions 20, 20' (in FIGS. 9, 9A, and 9B) in turn, constitutes as shown a generally planar portion of the roofing panel defined proximate one or more of the upper 12*a* (12*a*' in FIGS. 9, 9A, and 9B) or lower 12*b* edges and one or more of the lateral edges 13*a*, 13*b* as mentioned previously. As shown best in FIGS. 9, 9A, and 9B, each tab 20' is further characterized by dimensions sufficient to permit relative lateral sliding movement of the hook 15 of another roofing panel therealong, thus facilitating relative sliding movement of adjacent roofing panels due to thermal expansion and contraction, all as described further hereinbelow.

As will be appreciated with reference to this specification, the arrangement of hooks 15 and tabs 20 may be reversed, or a combination of hooks 15 and tabs 20 may be provided on the edges 12*a* or 12*b*, 13*a* or 13*b*, as desired.

Referring now to FIGS. 1A, 1B, and 9, securement of each individual roofing panel 10 to the roofing substrate or underlayment is facilitated by the provision of a plurality of laterally extending slots 21 (21' in FIG. 9) positioned about the perimeter of the roofing panel, including at least along the upper edge 12*a* (12*a*' in FIG. 9). Each such slot 21, 21' is dimensioned to receive a fastening element, such as nail N or the like, therethrough. As shown, each slot 21, 21' is defined along a vertically recessed portion of the panel edge 12*a* (12*a*' in FIG. 9), with tabs 20, 20' being defined therebetween by vertically raised portions of the same edge.

Referring specifically to FIG. 1B, in order to reinforce the structure of each roofing panel 10, and further to aid in maintaining the upper surface 11*a* at a desired distance from the roofing substrate so as to facilitate the circulation of air therethrough, the bottom surface 11*b* of the each roofing panel 10 includes a plurality of ribs or stand-offs 22 projecting downwardly therefrom.

Figure 8:
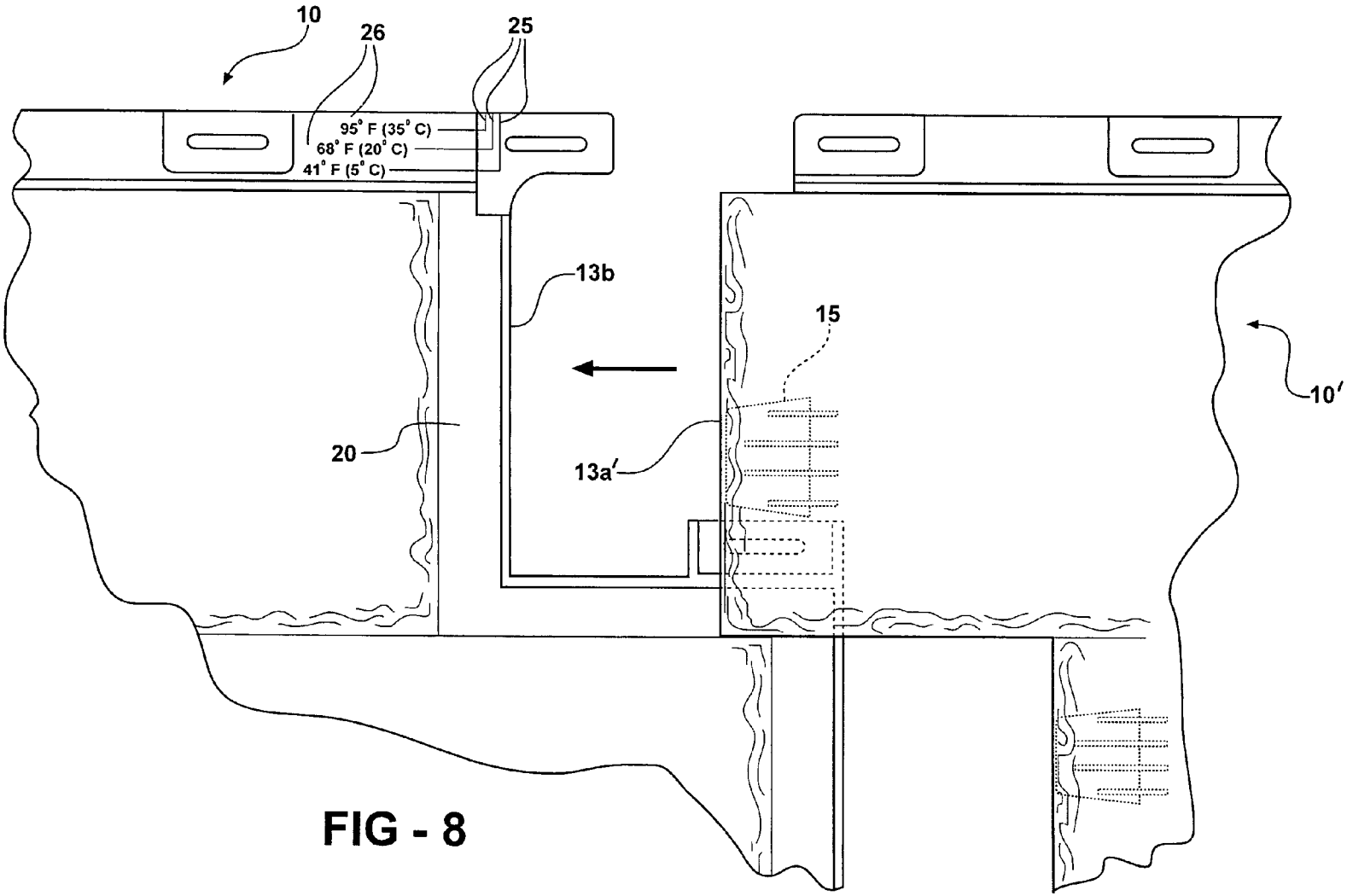
FIG. 8 is a detailed top plan-view depicting the manner of engagement between horizontally adjacent roofing panels.

Referring now to FIG. 8, each roofing panel 10 is optionally provided with indicia facilitating the selective horizontal spacing of each roofing panel with a horizontally adjacent roofing panel, thereby ensuring that subsequent expansion and contraction of roofing panels due to changes in ambient temperatures do not lead to unwanted separation or buckling of adjacent panels. More particularly according to the illustrated embodiment, each roofing panel is provided with a plurality of horizontally staggered lines 25 or other indicia each representing a desired position of the extreme lateral edge (indicated at 13*a*' in FIG. 8) of an adjacent roofing panel 10' in relation thereto and, by association, the extent of engagement between the tabs 20 and hooks 15' of such adjacent panels. These lines 25, which in the illustrated embodiment are positioned proximate a lateral edge 13*b* of each roofing panel 10, are further associated with indicia 26 reflecting several ambient temperatures, each such temperature reflecting an approximate ambient temperature under which the roofing panels of the present invention may be installed.

Turning next to FIGS. 1B, 9, 9A and 9B, each roofing panel 10 is, in order to facilitate the precise alignment of vertically adjacent roofing panels relative to each other, optionally provided with one or more flexible stops 30 projecting downwardly from the bottom surface 11*b* proximate each of those hooks 15 disposed adjacent the upper and/or lower edges 12*a*, 12*b*. As best shown in FIGS. 9A and 9B, each such stop 30 is positioned intermediate the length of an adjacent hook 15, thereby defining a stop surface for the upper edge 12*a*' of an adjacent panel 10' before the corresponding tabs 20' are fully received in the openings 17 in hooks 15 so that the edge 12*a*' abuts against the end walls 18 of hooks 15. Preferably, though not necessarily, one stop 30 is provided adjacent either side of each hook 15 as shown. The specific position of the abutments 30 is predetermined as that which will permit subsequent expansion and contraction of adjacent panels 10, 10'—and the corresponding relative movement of slidingly engaged hooks 15 and tabs 20'—due to changes in ambient temperatures without causing either unwanted separation of the panels occasioned by disengagement of the tabs 20' and hooks 15, or buckling of adjacent panels 10, 10' occasioned by the force of edge 12*a*' acting against the end walls 18 of hooks 15.

Preferably, though not necessarily, each abutment 30 is formed integrally with the panel 10, although it will be appreciated that the abutments 30 may be affixed to the panels 10 subsequent to their formation.

As mentioned, each stop 30 serves to define a positive stop for the lateral edge 13*b*' of an adjacent panel 10' as the panel 10 is installed, thereby identifying for the installer the preferred relative positioning between the panels 10, 10'. To permit subsequent relative movement of the installed panels 10, 10' as a result of changes in ambient temperatures, each stop 30 is also sufficiently flexible so as to yield (FIG. 9B) under the pressure of the lateral edge 13*b*' of an adjacent panel 10' acting thereagainst as such panel 10' expands in consequence of increased ambient temperatures.

Referring next to FIGS. 2A, 2B, 4A and 4B, the roofing system of the present invention further comprises a plurality of edging strips 40 each having a bottom edge 41*b* proximate which the edging strip is formed to represent the bottom edges of a plurality of individual shingles 43, an upper edge 41*a*, and opposite lateral edges 42*a*, 42*b*. As with the roofing panels 10 (not shown in FIGS. 2A and 2B), each edging strip 40 includes a plurality of slotted holes 44 for receiving fastening elements (such as nails or the like) therethrough. Also as with the roofing panels 10 described above, the plurality of slotted holes 44 are defined in vertically recessed portions of an upper edge 41*a* of the edging strip, while the vertically raised portions of the upper edge 41*a* positioned therebetween define a plurality of tab portions 45 slidingly engageable with hooks 15 of vertically adjacent roofing panels in a manner akin to that employed to slidingly engage the roofing members 10 with each other.

To facilitate the installation of adjacent edging strips 40, 40', etc. at desirable distances so as to permit the subsequent temperature-induced expansion and contraction of these elements without unwanted buckling or disengagement, each edging strip is optionally provided with indicia facilitating the selective horizontal spacing of each edging strip 40 with a horizontally adjacent edging strip 40'. More particularly according to the illustrated embodiment, best shown in FIG. 4A, each edging strip 40 is provided with a plurality of horizontally staggered lines 46 or other indicia each representing a desired position of the extreme lateral edge (indicated at 42*a*' in FIG. 4A) of an adjacent edging strip 40' in relation thereto. These lines 46 are further associated with indicia 47 reflecting several ambient temperatures, each such temperature reflecting an approximate ambient temperature under which the edging strips of the present invention may be installed.

In the illustrated embodiment, each edging strip 40 is formed of a suitable polymeric material such as is presently known in the art for the manufacture of roofing materials. However, it will be understood that other materials also known to those skilled in the art may be substituted. Also in the illustrated embodiment, each edging strip 40 is characterized by an overall length equivalent to the width of a single roofing panel 10. Again, however, it will be appreciated that this length may be varied, being either shorter or longer than that particularly illustrated.

Referring now to FIGS. 3A through 8, there is shown the exemplary installation of a roof according to the inventive system using the roofing panels 10 and edging strips 40 as heretofore described.

As with convention, the roofing system of the present invention is installed on a suitable substrate, such as wood panels adhered to the frame of a dwelling. Also per convention, it will be understood as desirable to have the substrate further covered with a waterproof underlayment material, such as a polymeric liner, sandwiched between the substrate and the elements of the roofing system.

Figure 3A:
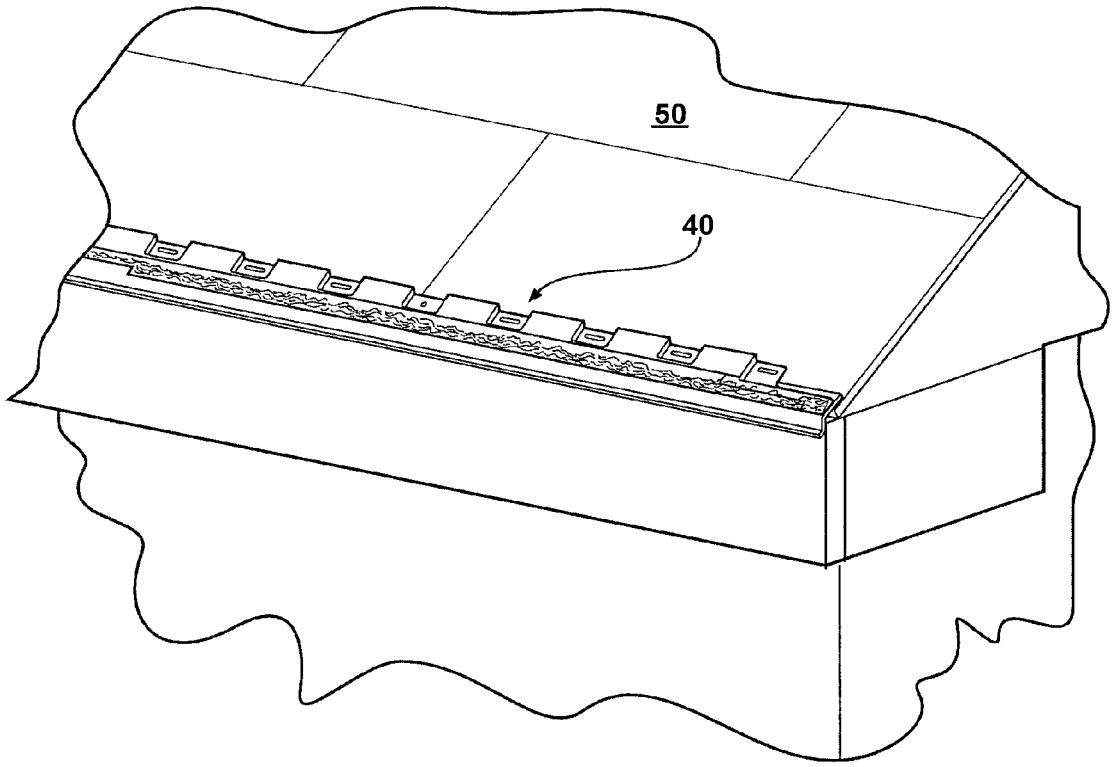
FIG. 3A depicts in perspective an edging strip according to the present invention, the edging strip shown in an operation environment secured to the roof substrate of a dwelling.
Figure 3B:
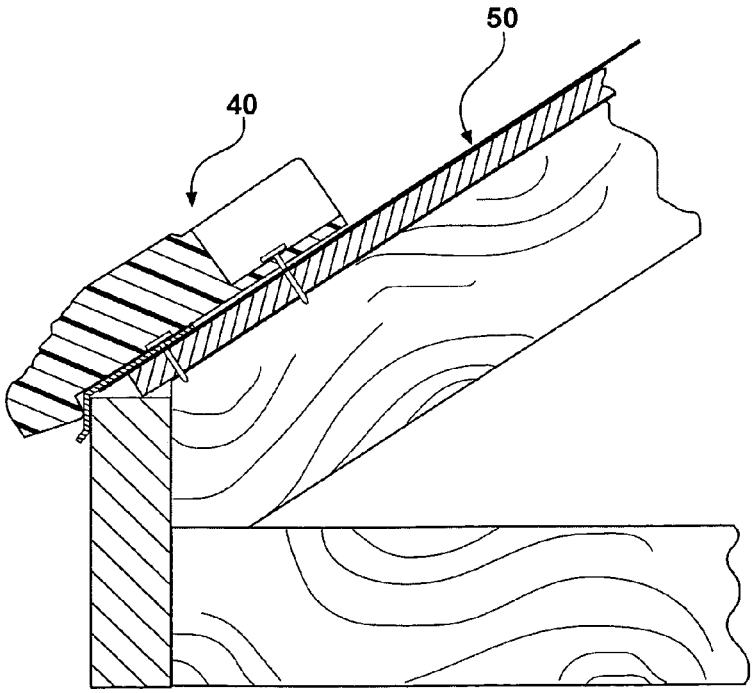
FIG. 3B is a cross-sectional view of the edging strip of FIG. 3A, taken along lines III.

Turning first to FIGS. 3A and 3B, the first step in installation of a roof according to the instant invention is to preferably secure a plurality of edging strips 40 along the bottom edge of the roof 50. Each strip 40 is laid successively, preferably beginning at the farthest lateral point along the bottom edge of the roof. When each edging strip 40 is in the desired position, fasteners such as nails or the like are inserted through one or more of the slotted holes 44 to secure the edging strip 40 to the roof substrate (e.g., wood panels overlaid with a water resistant sheathing).

Figure 4A:
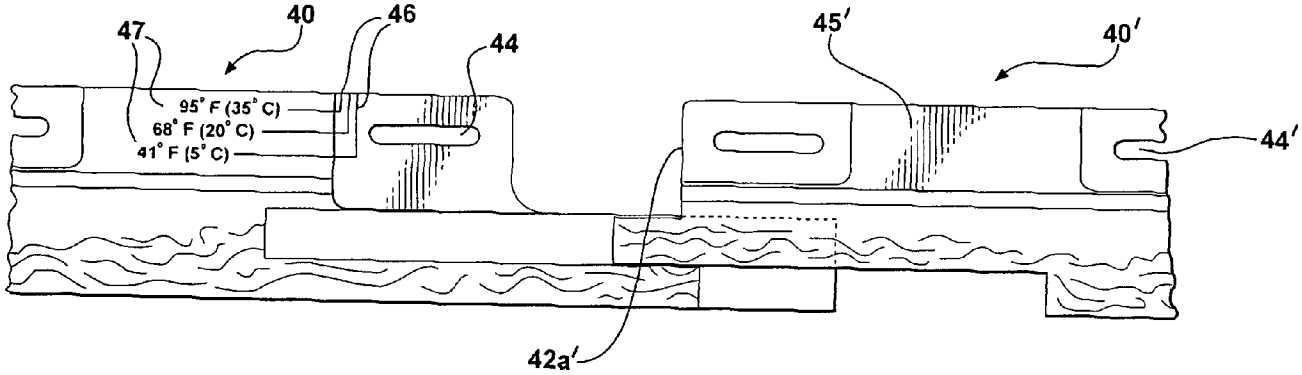
FIGS. 4A and 4B depict in perspective portions of the opposing ends of adjacent edging strips.
Figure 4B:
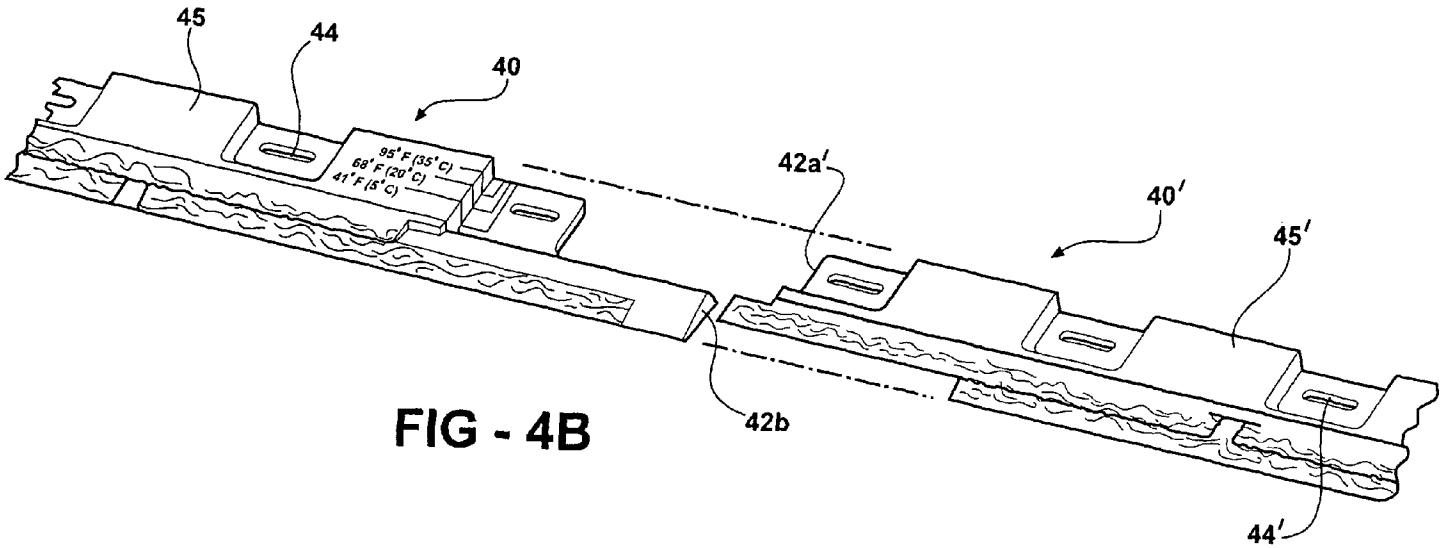

Referring next to FIGS. 4A and 4B, installation of successive edging strips 40', etc. is achieved by sliding such successive edging strip laterally into abutting contact with the preceding edging strip (e.g., 40) and thereafter securing the successive strip 40', etc. in place in the same manner described previously.

To facilitate the installation of the successive edging strips 40' at a distance relative to the preceding edging strip 40 permitting the subsequent temperature-induced expansion and contraction of these edging strips relative to each other without producing unwanted separation or buckling, the successive edging strip 40', etc. is positioned so that the terminal end 42*a*' thereof is aligned with the positioning line 46 or other indicia on the edging strip 40 which closest approximates the prevailing ambient temperature at the time of installation.

Figure 5:
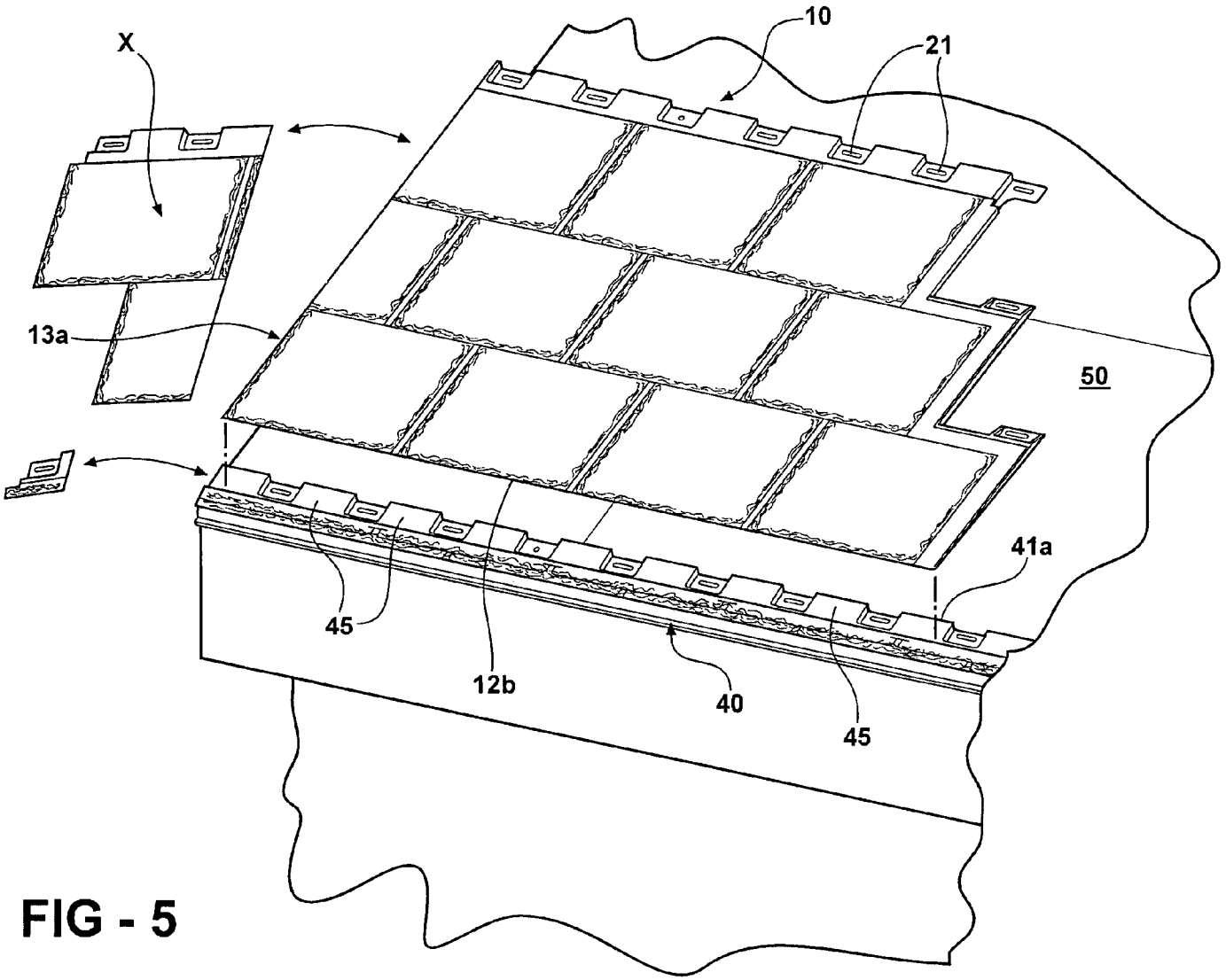
FIG. 5 is depicts in perspective the securement of a first roofing panel according to the present invention on to the roofing underlayment or substrate of a dwelling and into engagement with a previously installed edging strip.
Figure 6:
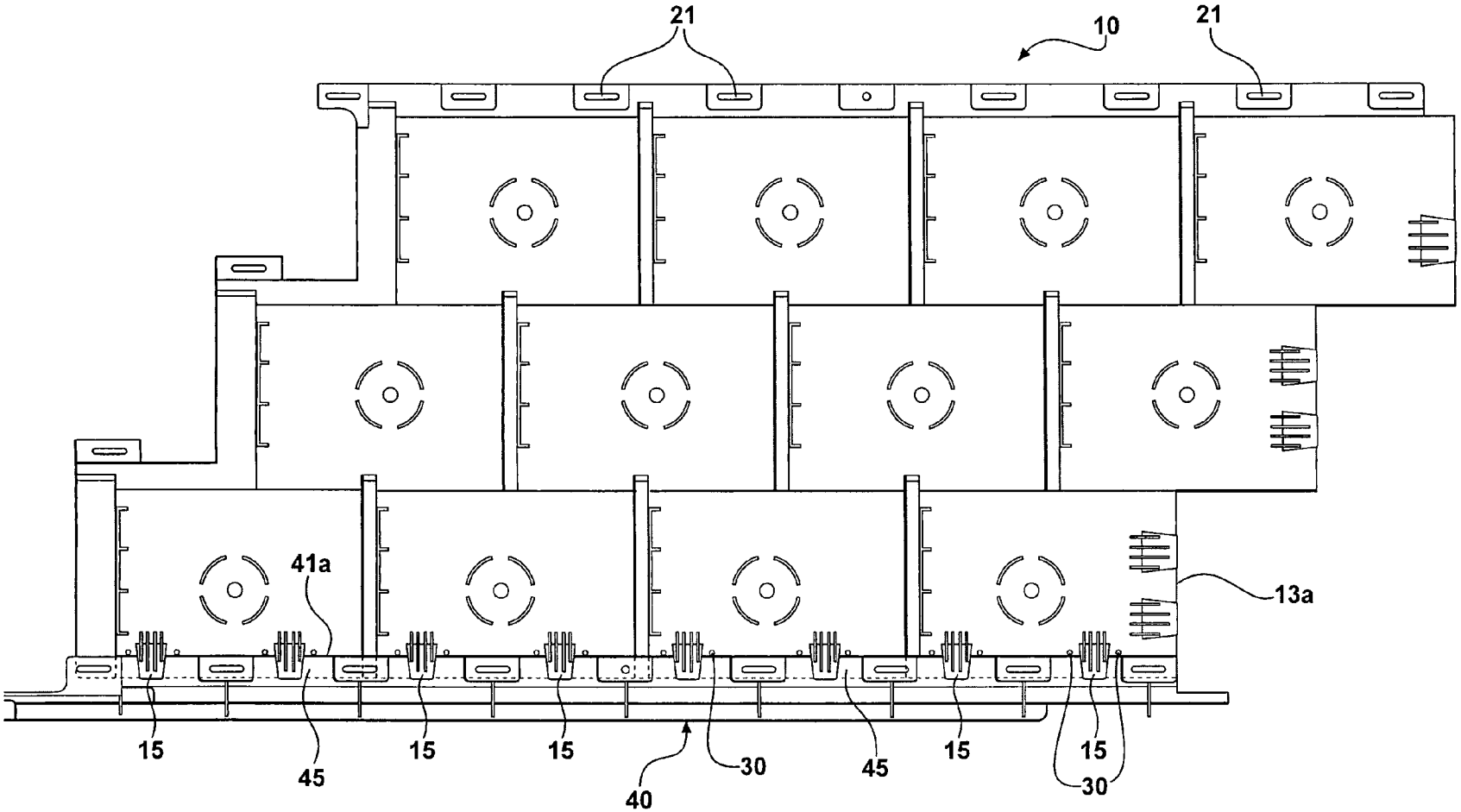
FIG. 6 is a bottom plan view of a roofing panel and edging strip in engagement with each other.

Referring next to FIGS. 5 and 6, installation of a first roofing panel 10 onto the roof 50 and into engagement with a previously installed edging strip 40 is depicted. More particularly, it will be seen that the roofing panel 10 is placed on the roof substrate such that the innermost lateral edge (denoted by 13*a* in FIGS. 5 and 6) is in alignment with the farthest lateral edge of the roof 50. The roofing panel 10 is then moved vertically downwards to bring the hooks 15 positioned along the lower edge 12*b* thereof slidingly into engagement with the correspondingly positioned tabs 45 defined along the upper edge 41*a* of the previously installed edging strip 40, in exactly the same manner as that described previously for engagement of the tabs and hooks of vertically adjacent roofing panels in reference to FIGS. 9, 9A and 9B. Thus, upon the first indication of abutting contact between the upper edge 41*a* and the stops 30 positioned adjacent each hook 15—thus identifying for the installing user that the relative position between the panel 10 and the upper edge 41*a* of the edging strip 40 is that which will permit subsequent vertical expansion of the panel 10 due to increases in the ambient temperature without causing unwanted buckling—the user preferably ceases urging the panel 10 further vertically downward into engagement with the edging strip 40.

With the roofing panel 10 so aligned relative to the edging strip 40, fasteners are inserted through the slotted holes 21 to fix the roofing panel 10 in position. Any excess X of the roofing panel 10 extending beyond the innermost lateral edge 13*a* of the roof 50 is then trimmed off to present a neat appearance therealong.

Figure 7A:
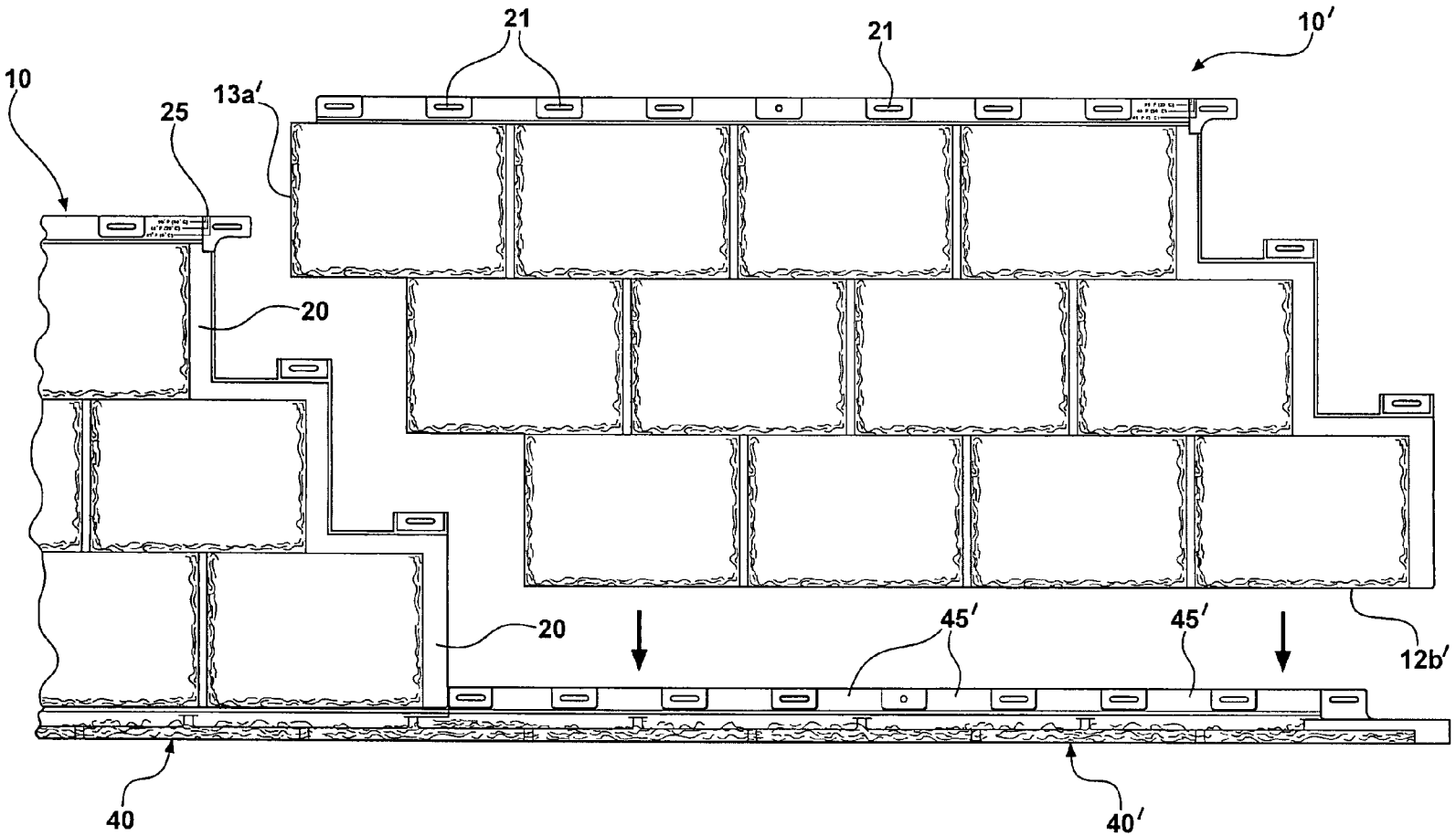
FIGS. 7A and 7B illustrate in top plan-view the manner of engagement between a single roofing panel and both a horizontally adjacent roofing panel and an edging strip.
Figure 7B:
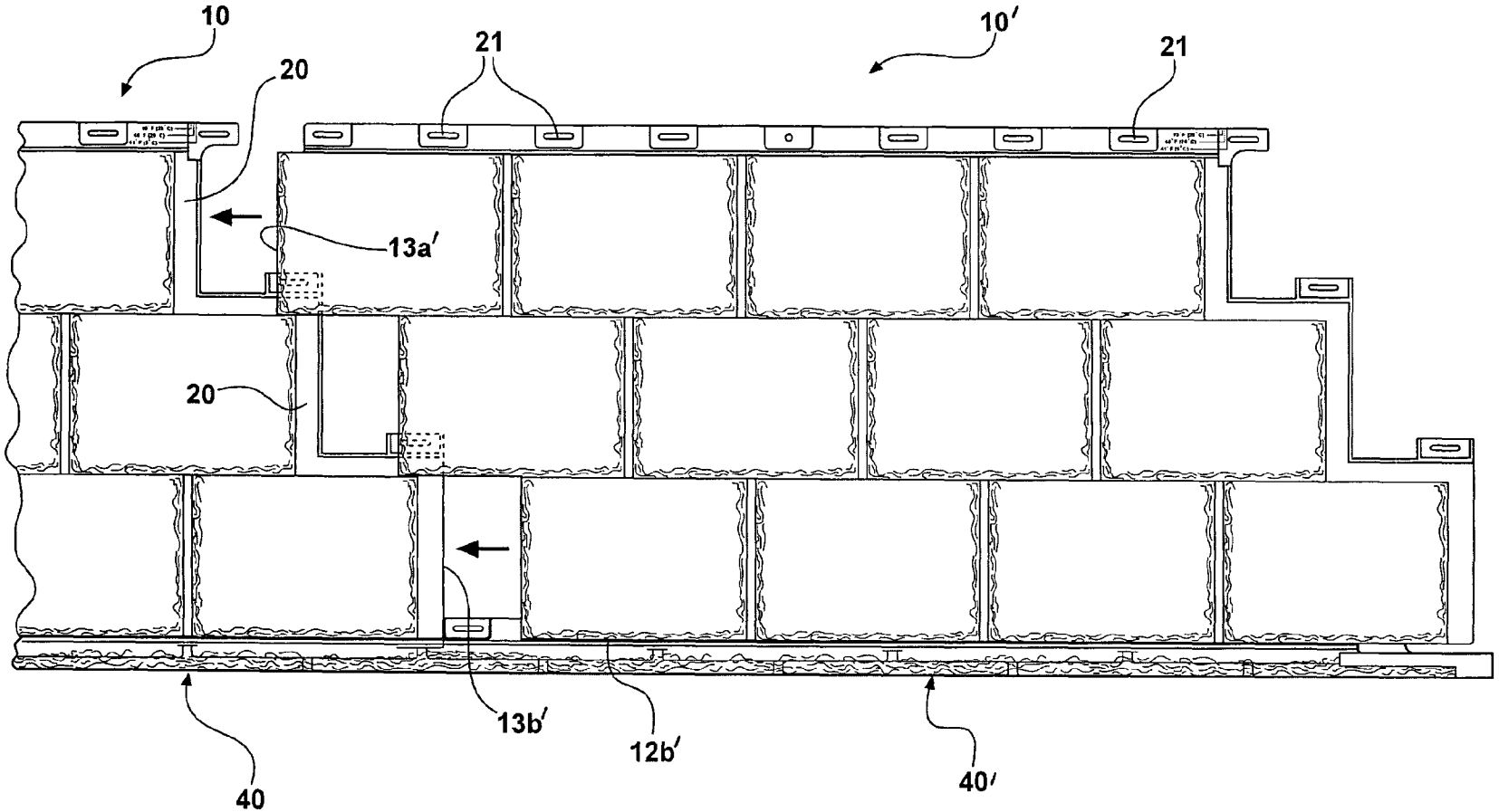

Turning now to FIGS. 7A and 7B, there is depicted the subsequent step of installing a second (or subsequent) roofing panel 10', etc. in position horizontally adjacent the previously installed roofing panel 10. More particularly, it will be seen that the roofing panel 10' is placed on the roof (not depicted) adjacent the previously installed roofing panel 10. The roofing panel 10' is then moved vertically downwards to bring the hooks 15 (not visible) positioned along the lower edge 12*b* thereof slidingly into engagement with the correspondingly positioned tabs 45 provided on the upper edge 41*a'* of the previously installed edging strip 40' in the same manner as described previously in connection with the roofing panel 10 and edging strip 40. The roofing panel 10' may then be slid horizontally towards the previously installed roofing panel 10 to bring the hooks 15' (not visible) positioned along the lateral edge 13*a'* thereof slidingly into engagement with the tabs 20 defined along stepped lateral edges 13*b* of the roofing panel 10.

To facilitate the installation of successive adjacent roofing panels 10, 10', etc. at a distance permitting the subsequent temperature-induced expansion and contraction thereof without causing unwanted separation or buckling of the panels, the installing user positions the outermost lateral edge 13*a'* of the panel 10' with the line 25 or other indicia which closest approximates the prevailing ambient temperature at the time of installation, all as described previously.

With the roofing panel 10' so positioned, fasteners are inserted through the slotted holes 15' to fix the roofing panel in position.

It will be understood from the foregoing that the installation of successive roofing panels in the same horizontal row of roofing panels 10, 10', etc. continues in the manner described until an entire row is installed across the roof. Thereafter, subsequent vertical rows of roofing panels are installed in similar fashion, with the hooks 15 provided along the bottom edge 12*b* of each such roofing panel being slidingly engaged with the tabs 20 provided along the upper edges 12*a* of vertically lower roofing panels in identical fashion to the engagement between the hooks 15 of roofing panels and the tabs 45 of the edging strips 40 already described hereinabove.

Upon complete installation of all rows of roofing panels on all surfaces of the roof, there is further installed a plurality of ridge panels (not shown) characterized by an inverted V-shaped cross-section. However, such ridge panels constitute no part of the current invention.

Naturally, variations in the exemplary manner of installation heretofore described are possible, as will be apparent to those of ordinary skill in the art, without departing from the broader aspects of the present invention.

It will be appreciated from the foregoing disclosure that the present invention provides a roofing system of employment thereof, which facilitates the inexpensive and rapid installment of a roof having the appearance of comprising multiple individual shingles.

Of course, the preceding specification is merely illustrative of the present invention, and those of ordinary skill in the art will appreciate that many additions and modifications to the present invention, as set out in this disclosure, are possible without departing from the spirit and broader aspects of this invention as defined in the appended claims.

The invention in which an exclusive property or privilege is claimed is defined as follows:

1. A roofing system, comprising: a plurality of roofing panels each having a bottom surface and a top surface, opposite upper and lower peripheral edges and opposite lateral peripheral edges, the top surface having the appearance of a plurality of individual shingles, and wherein each roofing panel comprises a plurality of hooks disposed on the bottom surface proximate at least the lower edge and at least one of the lateral edges, the hooks opening outwardly away from the roofing panel to thereby permit the peripheral edges of roofing panels disposed horizontally and vertically adjacent each other to be slidingly received therein;

wherein each roofing panel further comprises a plurality of tabs disposed proximate at least the upper edge and at least one of the lateral edges, wherein the tabs of each roofing panel are slidingly receivable within the hooks of vertically and horizontally adjacent roofing panels to thereby permit sliding engagement between roofing panels disposed horizontally and vertically adjacent to each other;

wherein further at least the upper edge of each roofing panel comprises a plurality of laterally extending slots for receiving fastening elements therethrough, the slots being defined along vertically recessed portions of the upper edge intermediate the plurality of tabs, and wherein the vertically recessed portions are positioned for abutting contact with a support surface, and said plurality of tabs are vertically raised relative to said recessed portions so as to avoid abutting contact with a support surface; and wherein further each vertically raised tab is slidingly receivable within the hook of a vertically adjacent roofing panel so that the hook is substantially disposed between the vertically recessed portions defined intermediate the vertically raised tabs.

2. The roofing system of claim 1, wherein the top surface of each roofing panel has the appearance of a plurality of individual shingles arranged in a plurality of vertically adjacent, horizontally extending rows.

3. The roofing system of claim 2, wherein the top surface of each roofing panel has the appearance of a plurality of individual shingles arranged in a plurality of vertically adjacent, horizontally extending rows with each successive row staggered relative to the preceding row, and wherein further the lateral edges of each roofing panel are stepped to correspond to the staggered rows.

4. The roofing system of claim 1, wherein the bottom surface of each roofing panel includes a plurality of ribs projecting downwardly therefrom.

5. The roofing system of claim 1, further comprising a plurality of edging strips each having the appearance of only the bottom portions of a plurality of individual shingles arranged in a horizontal row, and each edging strip further being slidingly engageable with the hooks proximate the lower edge of at least one roofing panel disposed vertically adjacent thereto.

6. The roofing system of claim 5, wherein each edging strip comprises a plurality of tabs positioned proximate an upper edge of the edging strip, said tabs adapted to engage with the hooks provided proximate the lower edge of a vertically adjacent roofing panel to permit sliding engagement therebetween.

7. The roofing system of claim 6, wherein the upper edge of each edging strip further comprises a plurality of laterally extending slots for receiving fastening elements therethrough, the slots being defined along vertically recessed portions of the upper edge intermediate the plurality of tabs provided on said upper edge, and wherein the vertically recessed portions are positioned for abutting contact with a support surface, and said plurality of tabs are positioned on portions of said upper edge which are vertically raised relative to said recessed portions so as to avoid abutting contact with a support surface.

8. The roofing system of claim 1, wherein each roofing panel further comprises indicia facilitating the selective horizontal spacing of each roofing panel with a horizontally adjacent roofing panel.

9. The roofing system of claim 8, wherein said indicia comprise a plurality of temperature lines each indicating a predetermined horizontal spacing between horizontally adjacent roofing panels at a predetermined ambient temperature.

10. The roofing system of claim 5, wherein each edging strip further comprises indicia facilitating the selective horizontal spacing of each edging strip with a horizontally adjacent edging strip.

11. The roofing system of claim 10, wherein said indicia comprise a plurality of temperature lines each indicating a predetermined horizontal spacing between horizontally adjacent edging strips at a predetermined ambient temperature.

12. The roofing system of claim 1, further comprising at least one flexible stop projecting from the bottom surface of each roofing panel and positioned for abutting contact with a lateral edge of another roofing panel positioned vertically adjacent thereto.

13. The roofing system of claim 1, further comprising a plurality of flexible stops positioned proximate each of the plurality of hooks disposed proximate the upper or lower edges, and each said stop projecting from the bottom surface of each roofing panel so as to be positioned for abutting contact with a lateral edge of another roofing panel positioned vertically adjacent thereto.

14. The roofing system of claim 1, further comprising;

a plurality of edging strips for installation as the vertically lowest course in a polymeric roof, each edging strip simulating the appearance of only the bottom portions of a plurality of individual shingles, and each edging strip further being slidingly engageable with of at least one roofing panel disposed vertically adjacent thereto.

* * * * *

UNITED STATES PATENT AND TRADEMARK OFFICE Certificate

Patent No. 7,735,287 B2 Patented: June 15, 2010

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Michel Gaudreau, Quebec (CA); Louis-André Gaudreau, Quebec (CA); François Lagloire, Quebec (CA); René Bilodeau, Quebec (CA); and Guillaume Alarie, Quebec (CA).

Signed and Sealed this Fourth Day of June 2013.

JOSHUA J. MICHENER
*Supervisory Patent Examiner*
Art Unit 3635
Technology Center 3600